US005724998A

United States Patent [19]

Gellatly et al.

[11] Patent Number: 5,724,998

[45] Date of Patent: Mar. 10, 1998

[54] RECONSTITUTED TOBACCO SHEETS AND METHODS FOR PRODUCING AND USING THE SAME

[75] Inventors: Grant Gellatly, Chester; Gus Keritsis, Richmond; Susan E. Wrenn, Chesterfield, all of Va.

[73] Assignee: Philip Morris Incorporated, New York, N.Y.

[21] Appl. No.: 697,123

[22] Filed: Aug. 20, 1996

Related U.S. Application Data

[63] Continuation of Ser. No. 342,686, Nov. 21, 1994, abandoned, which is a continuation of Ser. No. 865,964, Apr. 9, 1992, abandoned.

[51] Int. Cl.[6] ..... A24B 15/00

[52] U.S. Cl. ..... 131/372; 131/374

[58] Field of Search ..... 131/370, 372, 131/374

[56] References Cited

U.S. PATENT DOCUMENTS

| | | | |
|---|---|---|---|
| 1,961,866 | 6/1934 | Rooker . | |
| 2,485,670 | 10/1949 | Sowa et al. . | |
| 2,708,175 | 5/1955 | Samfield et al. . | |
| 2,747,583 | 5/1956 | Frankenburg et al. . | |
| 2,769,734 | 11/1956 | Bandel . | |
| 2,830,596 | 4/1958 | Frankenburg et al. . | |
| 2,887,414 | 5/1959 | Rosenberg et al. . | |
| 2,897,103 | 7/1959 | Gottscho . | |
| 2,955,601 | 10/1960 | Frankenburg et al. . | |
| 3,016,907 | 1/1962 | Rosenberg et al. . | |
| 3,097,653 | 7/1963 | De Gooijer . | |
| 3,115,882 | 12/1963 | Domeck et al. . | |
| 3,125,098 | 3/1964 | Osborne . | |
| 3,194,245 | 7/1965 | Clarke . | |
| 3,213,858 | 10/1965 | Merritt et al. | 131/140 |
| 3,258,014 | 6/1966 | Moshy | 131/370 |
| 3,353,541 | 11/1967 | Hind et al. . | |
| 3,386,450 | 6/1968 | Seligman et al. . | |
| 3,420,241 | 1/1969 | Hind et al. . | |
| 3,464,422 | 9/1969 | Light et al. . | |
| 3,480,018 | 11/1969 | Fairchild . | |
| 3,499,454 | 3/1970 | Hind | 131/370 |
| 3,528,434 | 9/1970 | Halter et al. . | |
| 3,529,602 | 9/1970 | Hind et al. . | |
| 3,861,400 | 1/1975 | Perkins et al. . | |
| 3,867,951 | 2/1975 | Buchmann et al. . | |
| 3,929,141 | 12/1975 | Beringer et al. . | |

(List continued on next page.)

FOREIGN PATENT DOCUMENTS

| | | |
|---|---|---|
| B 420 623 | 7/1969 | Australia . |
| A 681 330 | 10/1966 | Belgium . |
| 1080954 | 7/1980 | Canada . |
| A 2 344 236 | 3/1977 | France . |
| A 440 081 | 12/1967 | Switzerland . |
| A 909 273 | 10/1962 | United Kingdom . |
| 0935212 | 8/1963 | United Kingdom . |
| A 1 055 445 | 1/1967 | United Kingdom . |
| A 1 157 574 | 7/1969 | United Kingdom . |

*Primary Examiner*—Vincent Millin
*Assistant Examiner*—Kelly O'Hara
*Attorney, Agent, or Firm*—Charles E.B. Glenn; James E. Schardt; James T. Moore

[57] ABSTRACT

Reconstituted tobacco sheets manufactured from tobacco dust and binder are described herein. More particularly, the tobacco dust has a mean particle size in the range of from about 60 mesh to about 400 mesh to afford reconstituted tobacco sheets having about 80% to about 90% tobacco content with improved quality and survivability. The reduced particle size of the tobacco dust allows an increase in the solids content of the slurry without an increase in slurry viscosity. The increased solids content reduces the drying load of the cast sheet thereby allowing an increased production rate. The reconstituted tobacco sheets may be prepared from a slurry comprising tobacco dust and binder that may be subjected to a means for removing air trapped within the slurry before casting the slurry into sheets. An apparatus for determining the amount of air trapped within the slurry prepared according to the process of the present invention is also described herein.

2 Claims, 4 Drawing Sheets

U.S. PATENT DOCUMENTS 4,129,134 12/1978 Hind et al. .
4,142,535 3/1979 Perkins et al. .
4,144,894 3/1979 Schmidt et al. .
4,313,967 2/1982 Kahn et al. .
4,319,593 3/1982 Pinion et al. .
4,325,391 4/1982 Schmidt .
4,337,783 7/1982 Hooper et al. .
4,341,228 7/1982 Keritsis et al. .
4,421,126 12/1983 Gellatly .
4,674,519 6/1987 Keritisis et al. .
4,783,239 11/1988 Rich .
4,785,833 11/1988 Holzner et al. .
4,825,884 5/1989 Denier et al. .
4,874,000 10/1989 Tamol et al. .
4,880,645 11/1989 Carpenter et al. .
4,970,014 11/1990 Garcia .
5,019,288 5/1991 Garcia .

RECONSTITUTED TOBACCO SHEETS AND METHODS FOR PRODUCING AND USING THE SAME

This application is a continuation of Ser. No. 08/842,686 filed Nov. 21, 1994 now abandoned which is a continuation of Ser. No. 07/865,964 filed Apr. 9, 1992 now abandoned.

BACKGROUND OF THE INVENTION

This invention relates to a process for producing reconstituted tobacco sheets. More particularly, this invention relates to methods of producing reconstituted tobacco sheets of uniform thickness and increased survivability.

In the manufacture of tobacco products, such as cigarettes, some of the tobacco is, or becomes, ill-suited for such use during its processing. Generally, tobacco stems and leaf scraps result from the stripping of leaf tobacco. In addition, tobacco dust is produced when tobacco is treated, handled and shipped. Tobacco dust, tobacco stems and leaf scraps have been used in the past to produce reconstituted tobacco sheets, but have met with mixed success.

Once prepared, reconstituted tobacco sheets may be cut in a similar fashion as whole leaf tobacco to produce tobacco filler suitable for cigarettes and other smoking articles. During the processing of this material into filler, reconstituted tobacco sheets are often required to withstand wetting, conveying, drying and cutting. Like whole leaf tobacco, when reconstituted tobacco sheets are cut into filler some degree of breakage occurs thus creating tobacco dust as a by-product. The ability of the reconstituted tobacco sheet to withstand the rigors of processing with minimal tobacco dust by-product formation is a highly desirable characteristic since the loss of tobacco material would be lessened and the need to produce additional reconstituted tobacco sheets to meet a constant demand would be minimized. In that regard, the costs associated with the manufacturing of cigarettes and other smoking articles may be decreased.

Despite the various processes for the preparation of reconstituted tobacco sheets known in the art, many difficulties are encountered in manufacturing these sheets. Some of these processes are similar to tobacco paper-making processes in which tobacco dust is formed into sheets with the object being to use these sheets in a likewise manner as the original tobacco leaf; that is, cutting the tobacco sheet so that it may be combined with other shredded tobacco for use as tobacco filler in the production of cigarettes. Other conventional processes may also be used to prepare such sheets. For example, in U.S. Pat. No. 2,897,103, a process for manufacturing tobacco sheets which contain a substantial portion of non-tobacco ingredients is disclosed. Such non-tobacco materials often impart undesirable taste characteristics to the cigarette and thus the amounts of such materials should be minimized.

In another procedure, described in U.S. Pat. No. 4,325,391, the tobacco dust and binder, both in liquid media, are joined in a mixer, operating in an egg-beater fashion, to form a slurry and the slurry is then cast into sheets. However, once the tobacco slurries formed by these conventional processes have been cast into reconstituted tobacco sheets and subsequently dried, pitting may often be observed on the surface of the sheet due to air which tends to become trapped within the slurry mixture. Each pit that results from this trapped air translates into a thin spot or void in the final sheet, thereby lessening the survivability of the sheet during processing.

In addition, thickness variation of the reconstituted tobacco sheet also tends to reduce its survivability. When sheets of non-uniform thickness are cut into filler, they may exhibit a greater tendency to break as a result of thin spots found along the sheet surface. In that regard, it would be highly desirable to provide a reconstituted tobacco sheet useful for filler preparation, wherein the filler's length is not limited by sheet pitting.

A problem common to all of the reconstituted tobacco sheets that have been prepared by the processes known previously has been pitting and non-uniform sheet thickness which affects the survivability of the sheets. Moreover, the ability to initiate and terminate these processes in a rapid and efficient manner has not been demonstrated by the processes previously developed.

SUMMARY OF THE INVENTION

The present invention relates to reconstituted tobacco sheets useful as a smoking material, such as cigarette filler, which are made from a slurry of tobacco particles and binder. More particularly, the present invention relates to reconstituted tobacco sheets having improved quality and survivability due to an optimization of the tobacco mean particle size and a reduction in the air content of the slurry prior to casting the slurry into tobacco sheets. In addition, the present invention relates to substantially a four-step process for manufacturing such sheets comprising mixing tobacco dust particles, a binder, and other agents in an aqueous media to form a slurry; casting the slurry onto a continuous stainless steel belt; drying the cast slurry to form a reconstituted tobacco sheet; and removing the same. As an optional step, entrained air may be removed from the slurry prior to casting.

The present invention solves the problems referred to above by providing reconstituted tobacco sheets better able to withstand the rigors of processing. Accordingly, it is an object of the present invention to provide reconstituted tobacco sheets comprised of tobacco dust of about 60 mesh to about 400 mesh and a suitable binder, having a higher percentage of tobacco than reconstituted tobacco sheets known in the art. Moreover, humectants, tobacco preservative agents, and other additives may also be used in the slurry to prepare the reconstituted tobacco sheets of the present invention.

It is another object of the present invention to provide a method for producing reconstituted tobacco sheets comprising the steps of: preparing a slurry which comprises tobacco dust having a mean particle size in the range of about 60 mesh to about 400 mesh, a binder, an agent for preserving tobacco and an aqueous medium; casting the slurry onto a supportive device; drying the now-cast slurry to form a reconstituted tobacco sheet; and removing the same from the supportive device.

It is a further object of the present invention to provide a process for manufacturing reconstituted tobacco sheets having an additional step wherein entrained air is removed from within the slurry prior to casting.

It is yet another object of the present invention to provide an apparatus for measuring the amount of air that is trapped within a slurry.

BRIEF DESCRIPTION OF THE DRAWINGS

The above and other objects and advantages of the invention will be apparent upon consideration of the following detailed description and representative examples, taken in conjunction with the accompanying drawings, in which.

DETAILED DESCRIPTION OF THE INVENTION

Figure 1:
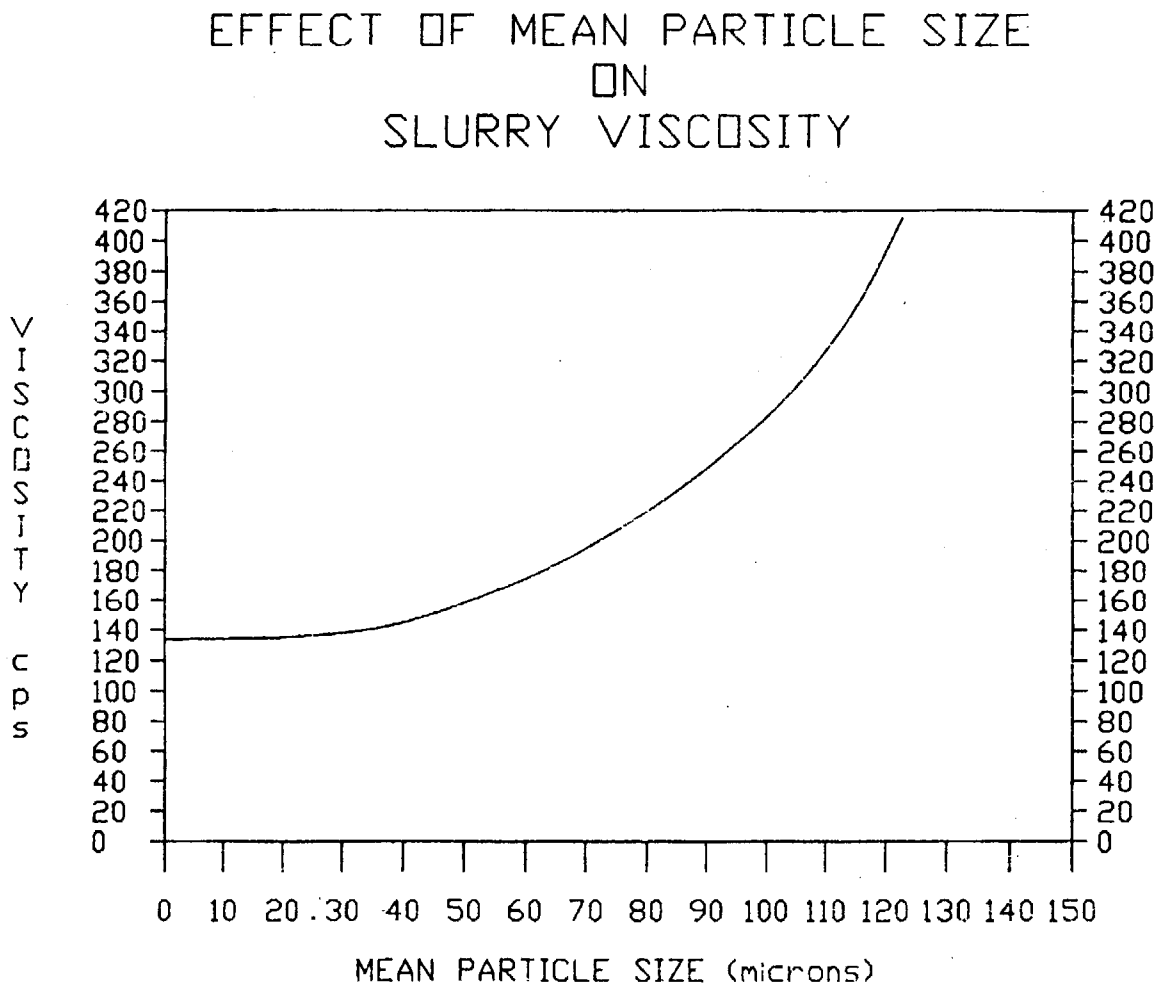
FIG. 1 is a plot of tobacco dust mean particle size in microns versus tobacco slurry viscosity for a slurry of a given solids content.

In order to fully appreciate the present invention, the following terms are defined as indicated.

"Ageing"—the length of time the tobacco dust is allowed to be contacted with the binder or binder release agent so chosen.

"Elongation"—the ability of the reconstituted tobacco sheet to be stretched prior to breaking. This term is expressed in terms of relative percent.

"Oven-volatiles content" or "OV"—a measure of the weight loss, expressed as %, of a sample of tobacco filler after subjecting the sample to a circulating air oven for three hours at 212° F. Although the weight loss may be attributable to tobacco volatiles as well as water content, OV is used interchangeably with moisture content and may be considered the equivalent of moisture content since, under the test conditions, not more than about one percent of the tobacco filler are volatiles other than water.

"Equilibrium OV"—the OV of a sample after equilibrating at a temperature of 75° F. and 60% RH for at least 48 hours.

"Filler"—cut blended, cured, and flavored tobacco ready for cigarette making.

"Humectants"—hygroscopic agents, such as glycerin and other glycols, that are often added to tobacco to assist in moisture retention and plasticity.

"Mesh"—all values are reported herein as United States standard sieve and those values reflect the ability of more than 95% of the particles of a given size to pass through a screen of a given mesh value. In that connection, mesh values reflect the number of mesh holes for each inch of screen.

"Pit" or "pitting"—an imperfection, cavity or crater often found in reconstituted tobacco sheets due to the presence of air trapped within the slurry matrix during casting.

"Reconstituted tobacco sheet"—a tobacco sheet of substantially uniform thickness and plasticity that may be produced by the rolling or casting of tobacco dust, stems, by-products and the like that are finely ground and that may be mixed with a cohesive agent or binder.

"Relative humidity" or "RH"—the percent of water in the atmosphere relative to the greatest amount of water saturation in the atmosphere possible at the same temperature.

"Sheet density"—a property which is the combination of sheet weight and sheet thickness of the reconstituted tobacco sheet. This term is expressed in terms of gms/cc.

"Survivability"—the ability of a reconstituted tobacco sheet to withstand the rigors of processing while creating a minimal amount of tobacco dust by-product.

"Tensile strength"—that amount of force applied to a reconstituted tobacco sheet necessary to cause the breakage thereof. This term is expressed in terms of kg/in.

"Tensile energy adsorbed" or "TEA"—a combination of tensile strength and elongation; that is, by plotting tensile strength as the ordinate against elongation as the abscissa the area under the curve so formed represents the TEA. The optimum TEA is believed to be that value at which the reconstituted tobacco sheet provides a survivability at least as good as that of whole leaf tobacco. This term is expressed in terms of kg/in/in$^2$.

"Tobacco dust"—minute tobacco particles, i.e., in the range of from about 8 mesh to greater (i.e., smaller in size) than about 400 mesh, created by tobacco breakage during the many manufacturing processes involving tobacco. The particles may be leaves, stems and the like from tobacco.

As will be appreciated from the disclosure of the present invention, the reconstituted tobacco sheets manufactured by the process as described herein possess an enhanced quality and survivability over those reconstituted tobacco sheets known previously in the art.

With reference to FIG. 1, the instant process uses tobacco dust which is dry ground to such a fine level (i.e., particles as small as less than about 400 mesh, less than about 32 microns) that a higher total solids content tobacco slurry is attained while the slurry maintains the same viscosity of tobacco slurries identified in the past. FIG. 1 shows that as the tobacco particle size is decreased, the viscosity of the slurry decreases for a given solids-content slurry. In addition, the use of finely ground tobacco dust improves the homogeneity of the reconstituted tobacco sheet thereby increasing the length of the tobacco filler which may be prepared from it.

Moreover, the tobacco content of the slurry, and ultimately the sheet prepared from it, is about 80% to about 90%—the remaining 10–20% is comprised of binder, humectants, preservatives, and flavors—which surpasses the tobacco content found in the reconstituted tobacco sheets prepared in the past. As a further advantage, the manufacture of reconstituted tobacco sheets according to the process of the present invention may be commenced and ceased with relative ease as compared with processes previously available in the art which often included a three-hour slurry ageing step prior to casting.

Figure 2:
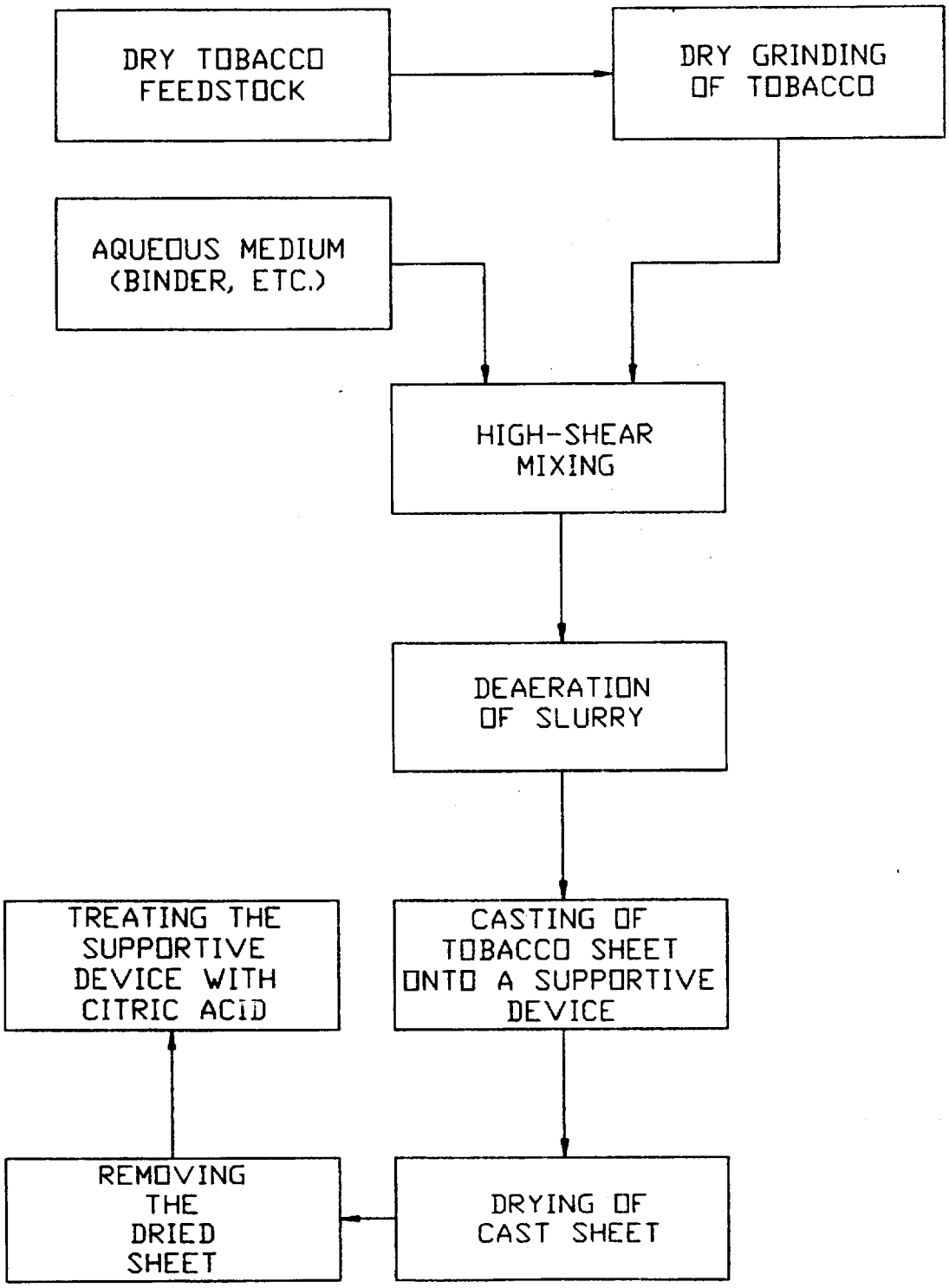
FIG. 2 is a block diagram of the process of the present invention.
Figure 2A:
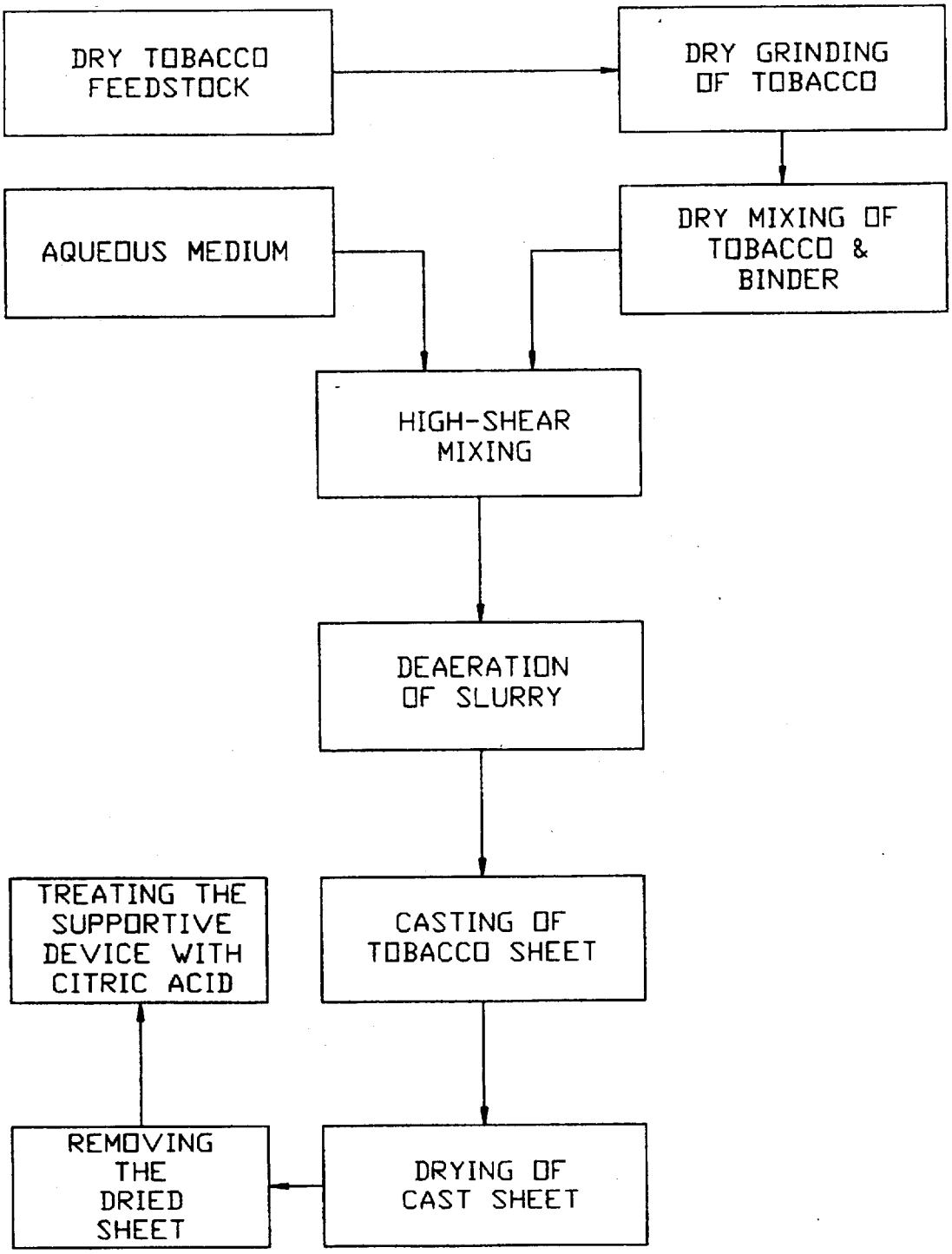
FIG. 2*a* is a block diagram of an alternate embodiment of the process of the present invention.

Referring to FIG. 2, there is shown a block diagram of the process of the present invention. Dry tobacco feedstock, preferably tobacco dust, is fed to a grinder where it is dry ground and screened to the desired size distribution. The ground tobacco dust is contacted with an aqueous medium which may include binders, humectants, flavorings, etc., in a high-shear mixer to form a tobacco slurry. Alternatively, as shown in FIG. 2*a*, the dry binder may be blended with the dry tobacco before mixing same with an aqueous medium. After mixing, the tobacco slurry may be deaerated before it is cast as a sheet onto a supportive device. The reconstituted tobacco sheet is then dried and removed from the supporting device. The finished sheet may then be cut in a similar fashion as whole leaf tobacco to produce tobacco filler suitable for cigarettes and other smoking articles.

In order to prepare a reconstituted tobacco sheet according to the present invention, first an aqueous tobacco slurry is formed. The slurry comprises tobacco dust, a binder, and an aqueous medium. In addition, the slurry may also contain an agent for preserving tobacco. Preferably, the components of the slurry are mixed in a ribbon blender then subjected to shear in a high-shear mixer. Then the slurry is cast onto a moving endless belt. The cast slurry is passed through a drying assembly to remove moisture such that a reconstituted tobacco sheet is formed. Finally, the sheet may be removed from the belt by any sharp instrument, such as a doctor blade. The removal may be facilitated by moistening the sheet prior to doctoring it from the belt.

In another embodiment of the present invention, air which has become entrained within the slurry may be removed from it prior to casting the slurry onto the belt.

More specifically, the reconstituted tobacco sheets of the present invention may be prepared by combining tobacco dust of a reduced particle size with a binder in an aqueous media to create a slurry. The slurry may be prepared in a batch method or in a continuous method whereby the tobacco dust may be mixed with the binder in water in a high-shear mixing apparatus, such as a Waring Blender manufactured by Waring of Waring, Conn. or a Cowles Dissolver manufactured by Cowles of Moorehouse, Calif. However, it is most preferred that a refiner be used to impart a high shear to the slurry. Humectants may be added to this slurry in order to ensure that the tobacco remains flexible. If desired, agents which preserve the quality of tobacco and thereby assist in the prevention of fungi growth may also be added to the slurry.

Although tobacco dust from any type of tobacco may be used, certain types of tobacco dust by-products are preferred. Particularly preferred particles are from the following tobacco varieties: Flue-Cured, Turkish, Burley, Virginia, Maryland, Oriental, or any combination of these.

Tobacco particle size has been examined in connection with its effect on the degree of survivability. In accordance with the present invention, a reduced particle size is beneficial due to its effect on reducing the viscosity of the tobacco slurry, thereby allowing the total solids content of the slurry to be increased without substantially changing the desired viscosity of the slurry. The enhanced solids content of the slurry reduces the drying load of the process.

In addition, by choosing a smaller tobacco particle size, less binder may be required to form the reconstituted tobacco sheets described herein. For example, sheets made from about 120 mesh tobacco dust and about 10 parts pectin are substantially equivalent in quality and survivability to reconstituted tobacco sheets made from about 400 mesh tobacco dust and about 4 parts pectin. The pectin chosen may be any pectin identified in the present invention. The use of less binder permits a greater amount of tobacco to be used in connection with the production of the sheet. In this manner, aromatic and flavor characteristics closer to whole leaf tobacco will be provided to the reconstituted tobacco sheet.

Without intending to be bound by theory, it is believed that by dry grinding the tobacco dust to a finer particle size, the pectin contained in the tobacco will be released more efficiently and completely with greater rapidity. In this regard, the reduction in particle size tends to permit a quicker cast time when it is contacted with diammonium phosphate ("DAP") and ammonia because of the greater surface area of the tobacco dust with smaller mesh values. Further, the higher total solids content also decreases the amount of time necessary to dry the sheet which translates into a more efficient and cost effective method for manufacturing reconstituted tobacco sheets.

Suitable mean particle sizes of tobacco dust for use in the manufacturing of the reconstructed tobacco sheets of the present invention may be chosen within the range of about 60 mesh to about 400 mesh or higher mesh values (i.e., smaller particle sizes). However, a tobacco particle size of about 120 mesh is preferred. This particle size offers a compromise between the advantages of an even finer mesh size and the costs related to producing such fine particles.

In addition to controlling the mesh values of the tobacco dust used in the process of the present invention, it is also advantageous to add a binder, such as any of the gums or pectins described herein, or to have a binder released from the tobacco itself (e.g., tobacco pectin) to ensure that the tobacco dust remains substantially dispersed throughout the reconstituted tobacco sheet. For a descriptive review of gums, see Gums And Stabilizers For The Food Industry, IRL Press (G. O. Phillip et al. eds. 1988); Whistler, Industrial Gums: Polysaccharides And Their Derivatives, Academic Press (2d ed. 1973); and Lawrence, Natural Gums For Edible Purposes, Noyes Data Corp. (1976).

Various gums and pectins have been used as binders in reconstituted tobacco sheets to assist in keeping the integrity of the sheets intact. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binders for use in the present invention are pectin and guar.

Pectins are generally known to act as hygroscopic agents which facilitate the retention of moisture. The effect of about 10% citrus pectin as a binder combined with tobacco dust particles of varied mesh values is illustrated in TABLE 1 below:

TABLE 1

EFFECT OF TOBACCO PARTICLE SIZE WITH ABOUT 10% CITRUS PECTIN

| Tobacco Mesh Size | Tensile Strength (kg/in) | Elongation (%) | TEA × $10^3$ (kg/in/in$^2$) | Sheet Density (gms/cc) |
|---|---|---|---|---|
| 120 | 1.1 | 2.1 | 21 | 0.54 |
| 200 | 1.6 | 2.2 | 33 | 0.85 |
| 400 | 1.9 | 2.8 | 50 | 1.04 |

TEA values are for a 12 g/ft$^2$ sheet.
A vacuum was applied to the slurry prior to casting to remove entrained air.

The tobacco dust and binder may be advantageously employed in a weight ratio of from about 50:1 to about 10:1. This ratio may shift somewhat depending on the tobacco particle size and tobacco types chosen for manufacturing the reconstituted tobacco sheets of the present invention. The effect of varied percentages of citrus pectin in the tobacco slurry on the properties of reconstituted tobacco sheet prepared from slurries deaerated prior to casting is illustrated in TABLE 2 below:

TABLE 2

EFFECT OF CITRUS PECTIN (400 Mesh Tobacco)

| Pectin (%) | Tensile Strength (kg/in) | Elong-ation (%) | TEA × $10^3$ (kg/in/in$^2$) | Sheet Density (gms/cc) |
|---|---|---|---|---|
| 4 | 1.3 | 2.1 | 27 | 0.75 |
| 6 | 1.7 | 2.6 | 39 | 0.88 |
| 8 | 2.0 | 4.0 | 86 | 1.06 |

TEA values for a 12 g/ft$^2$ sheet.

A preferred pectin for use as a binder is tobacco pectin which may be released from the tobacco itself. Such release is often, but not always, enhanced by the addition of chemical release agents. For instance, the addition of DAP and ammonia has been demonstrated to afford advantageous results.

It is preferred that the pH of the slurry be maintained at about 9 when tobacco pectin, released from the tobacco itself, is used as the binder. Ammonia or any other suitable organic base may be used to raise the slurry pH. Moreover, it is preferred that the slurry age for from about ¼ hour to about 3 hours to allow the pectin to release sufficiently from the tobacco.

When pectin other than tobacco pectin or guar gum is used as the binder, it is preferred that the pH of the slurry be slightly acidic, about 5 to about 6. It is not necessary to age the slurry when the binder selected is a binder other than tobacco pectin released from the tobacco.

It is preferred that the binder is heated to from about 80° F. to about 180° F. prior to casting the slurry into a sheet. Most preferably, the binder, while in the slurry, is heated to from about 60° F. to about 200° F.

Another preferred embodiment comprises a combination of a binder, e.g., guar, pectin or one of the other binders disclosed herein, together with a pectin release agent, e.g., DAP and ammonia or other such release agent disclosed herein. By varying the relative quantity of these components in the slurry, the subjective attributes of the reconstituted tobacco sheet can be adjusted to levels intermediate of sheet constructed using either of the components alone.

In addition, the water used to prepare the tobacco slurry may be hard water or soft water mindful of the binder used. That is, should the binder chosen be tobacco pectin, soft water is preferred so that the formation of calcium phosphate may be minimized or avoided when DAP solution is prepared.

Tobacco dust conforming to the mean particle sizes of this invention may be obtained from any of the processes known for manufacturing tobacco products as an incidental by-product of these processes. In that regard, the size of the particles of tobacco dust may be reduced in accordance with the present invention by any process that is generally capable of grinding particles. Nonetheless, preferred among these grinding techniques are impact grinding and roller grinding. The percentage of particle sizes obtained by each of these methods is shown in TABLE 3 below:

TABLE 3

PARTICLE SIZE DISTRIBUTION FROM IMPACT AND ROLLER GRINDING TECHNIQUES

| Mesh | Avg. Particle Size (μ) | Type of Mill Roller (%) | Type of Mill Impact (%) |
|---|---|---|---|
| 60 | 375 | 8 | 0 |
| 120 | 187 | 22 | 14 |
| 200 | 100 | 18 | 19 |
| 400 | 56 | 28 | 27 |
| >400 | 25 | 24 | 40 |
| Mean Particle Size (μ) | | 110 | 70 |
| Relative No. Particles/lb. | | 2 | 8 |

In order to narrow the size range of tobacco dust particles that are used in the processes of the present invention, a technique which is capable of discriminating between various particle sizes may be employed. Any instrument or technique may be used that exhibits the capabilities of achieving this objective, although an Alpine Sieve Tester, manufactured in Germany, is preferred to obtain a mean particle size of about 120 mesh to about 400 mesh or higher mesh value.

It is also advantageous to use tobacco dust with a high mesh value, preferably with a substantially uniform particle size, because such a particle size will provide an expedited and more complete reaction in the slurry between the tobacco dust and the binder. The tobacco sheets that are produced from tobacco dust of about 120 mesh, 200 mesh, and 400 mesh display the following characteristics which are reported in TABLE 4 below:

TABLE 4

EFFECT OF TOBACCO MESH SIZE (Tobacco Pectin Release By DAP & Ammonia)

| Tobacco Mesh Size | Tensile Strength (kg/in) | Elongation (%) | TEA × $10^3$ (kg/in/in$^2$) | Sheet Density (gms/cc) |
|---|---|---|---|---|
| 120 | 0.9 | 4.7 | 35 | 0.82 |
| 200 | 1.0 | 4.4 | 39 | 0.90 |
| 400 | 0.9 | 4.5 | 39 | 1.07 |

TEA values for a 12 g/ft$^2$ sheet.
A vacuum was applied to the slurry prior to casting.

In view of the data presented in TABLE 4 (and TABLE 1) it may be appreciated that tobacco dust of smaller particle sizes impart greater characteristics of survivability to the reconstituted tobacco sheet of the present invention due to the enhanced chemical interactions that are believed to occur between the particles and the binder. Thus, these chemical interactions—in the case of tobacco pectin, between the tobacco dust and the DAP/ammonia combination—are believed to facilitate the release of the pectin from tobacco dust. Alternatively, in the case of binders, other than tobacco pectin, which are added to the slurry, a more rapid and efficient interaction results due to the greater surface area created by a reduced particle size.

According to one mode of the present invention, a humectant may also be added to the tobacco slurry to benefit from their known ability to act as plasticizers. Any humectant may be used, although glycols, such as glycerine, propylene glycol and the like, may be advantageously employed with the process described herein. In addition, agents useful for the preservation of tobacco, such as propionates, carbonates, benzoates and the like, may also be employed as antifungicides and antioxidants in the reconstituted tobacco sheets of the present invention. Preferred among these agents is potassium sorbate.

During the preparation of the slurry, it is advantageous to ensure that the total solids content is between about 15% and about 30%, preferably this range is between about 17% and about 25%. Of this preferred range, about 80% to about 90% of the total solids should be tobacco in order to provide a higher quality reconstituted tobacco sheet with improved taste characteristics. As indicated above, the slurry may be formed in a batch method or in a continuous method cognizant of the above-noted range of solids content.

Small tobacco particles, preferably in the range of from about 60 mesh to about 400 mesh may be used to form the tobacco slurry. Air that becomes trapped within the slurry may be removed prior to its casting in order to produce reconstituted tobacco sheets of superior quality—i.e., having uniform sheet thickness with minimal observable pitting thereon.

In TABLE 5 below, the effect of air removal from the tobacco slurry prior to casting is demonstrated. The slurries used to cast the test sheets were subjected to a vacuum of about 15-inches of mercury prior to casting; the control sheets were not subjected to a vacuum.

TABLE 5

EFFECT OF AIR REMOVAL FROM SLURRY (10% Citrus Pectin)

| Tobacco Mesh Size | Tensile Strength (kg/in) | Elongation (%) | TEA × $10^3$ (kg/in/in$^2$) | Sheet Density (gms/cc) |
|---|---|---|---|---|
| 200 | | | | |
| Control | 1.4 | 1.7 | 22 | 0.84 |
| Test | 1.9 | 2.7 | 45 | 0.86 |
| 400 | | | | |
| Control | 1.9 | 2.1 | 37 | 0.98 |
| Test | 1.9 | 3.6 | 63 | 1.11 |

In accordance with the present invention, the tobacco slurry may be cast, or extruded, onto a supportive surface. This supportive surface may be any one of a number of surfaces, although a continuous stainless steel belt is preferred. In any event, in one mode of the present invention, prior to introducing the slurry onto the supportive surface, air that has been trapped within the slurry will be removed from it.

Any number of instruments, assemblies or techniques may be used to remove substantially all of the air contained within the slurry prior to casting or rolling the slurry into tobacco sheets. A particularly preferred instrument is a Versator manufactured by Cornell Machine Company of Springfield, N.J. With the Versator, a vacuum may be applied to the vessel between the slurry forming step and the slurry casting step at a reduced atmosphere of from about 20-inches of mercury to about 30-inches of mercury.

In addition, since many of the binders suitable for use in the production of reconstituted tobacco sheets may be susceptible to hydrolysis at excessively elevated temperatures, the preferred temperature range for casting the slurry onto the belt is from about 80° F. to about 200° F. A particularly preferred temperature is about 180° F. By casting at temperatures in this preferred range, the viscosity of the slurry is lowered and, thus, as described above, an increased total solids content may be obtained for this slurry at the same degree of viscosity.

Figure 3:
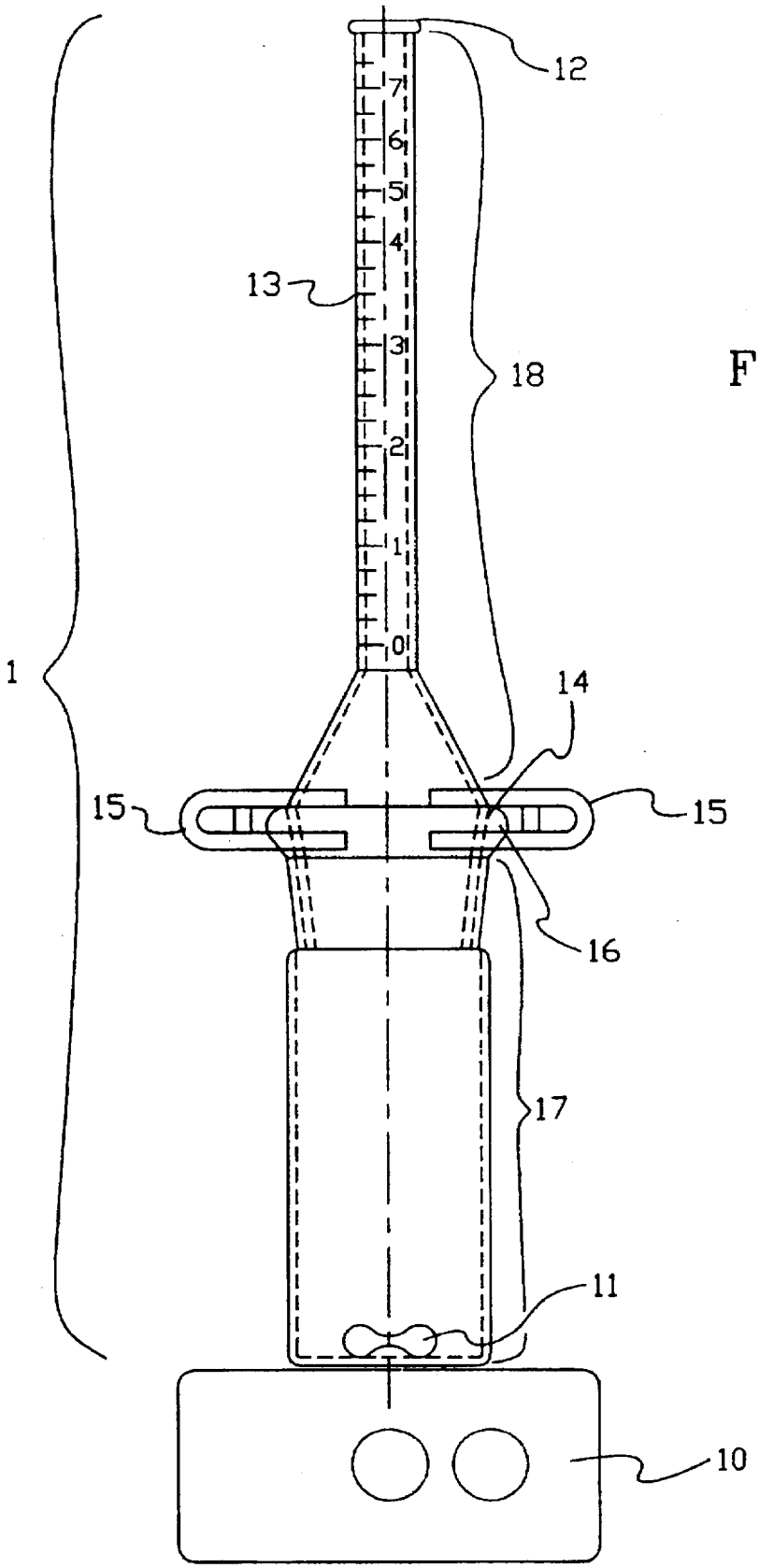
FIG. 3 depicts an apparatus used for measuring the amount of air trapped within a tobacco slurry used to produce the reconstituted tobacco sheets of the present invention by the process described herein.

In another aspect of the present invention, there is provided an apparatus, depicted in FIG. 3, that can be used to measure the amount of air that may be removed from the slurry. This amount will vary depending on the degree of vacuum that is placed on the vessel and the length of time that such vacuum is applied. To effect such measurement, a known mass of slurry, about 15 grams to about 20 grams, should be placed into a tared lower section 17 of the apparatus 1 which contains a magnetic stirring bar 11. Any predetermined amount of the slurry may be used, taking into consideration the size limits of the tared lower section 17 of the apparatus 1. The upper joint 16 of the tared lower section 17 of the apparatus 1 should have the lower joint 14 of the upper section 18 of the apparatus 1 inserted therein. Then the clamps 15 should be placed around the union of upper joint 16 of the lower section 17 and lower joint 14 of the upper section 18 of the apparatus 1 such that the upper section 18 and lower section 17 are thereby clamped. The calibrated portion 13 of the apparatus 1 which may be marked in milliliters or any other convenient volume units, should be filled with an ambient temperature liquid, preferably of low viscosity, e.g., water, without disturbing the slurry, through an opening 12 at the top of the apparatus 1, to any level on the calibrated portion 13 of the apparatus 1, although a level of about 2 to about 3 on calibrated portion 13 is preferred. Although any liquid which does not react with the tobacco slurry may be used, a low viscosity liquid is preferred over a high viscosity liquid because a high viscosity liquid will require longer time for the entrained air to degas.

Once the liquid has been added and the liquid mark duly noted on the calibrated portion 13 of the apparatus 1, the magnetic stirrer 10 may be turned on to begin stirring the slurry mixture slowly. This is continued for about 5 minutes to about 15 minutes, or until the slurry is dissolved or becomes homogeneous. The magnetic stirrer 10 may then be turned off to permit the system to equilibrate. In this manner the amount of air trapped within the slurry sample may be determined by subtracting the new level which the liquid has now reached on the calibrated portion 13 of the apparatus 1 from its initial reading.

The values so obtained may now be used according to the following formula in order to determine the air content of the tobacco slurry expressed as cc air/kg slurry:

$$\frac{\text{Initial Volume Reading (cc)} - \text{Final Volume Reading (cc)}}{\text{Slurry Weight (gms).}} \times 1000$$

The determination of air content in the slurry over a period of tests will permit a worker to make a well-informed judgment based on past experience about the amount of air contained in the slurry and how the amount of air entrained in the slurry will affect the survivability of the sheet that is formed. Thus, it will be advantageous to take such measurements during the production of reconstituted tobacco sheets in order to produce sheets of the highest quality and survivability that the various parameters and components will permit.

After removing air from the slurry, the now substantially air-free slurry may be cast onto any supportive device, such as a stainless steel belt. The temperature at which the cast slurry should be dried is in the range of about 200° F. to about 700° F., although about 212° F. to about 600° F. is preferred. The steel belt may advance at a rate of about 100 ft/min up to about 500 ft/min, although a typical rate of operation is about 400 ft/min. Once cast, the sheet may be dried to remove the aqueous medium used in the slurry. Drying of the now-cast slurry to form reconstituted tobacco sheets may be achieved by any conventional method, although a gas-fired drier or a steam-heated belt are preferred.

Since a greater total solids content is achieved in the tobacco slurry as described herein, the amount of aqueous medium present in the slurry is reduced. Thus, the reconstituted tobacco sheets of the present invention may be dried at a more rapid rate. The sheets should be dried to a level of from about 14% to about 18% OV, with about 16% OV being preferred. It is preferred that the sheet be removed from the belt when it has been dried to an OV of about 25% to about 40%.

After sheet removal, the belt may be treated with about 10% citric acid to solubilize deposits which remain on the belt. A brush which turns countercurrent to the direction which the belt is driven will loosen these deposits—present after citric acid treatment as a softened film—which may be washed off the belt with water. The belt may be wiped dry and then treated with a release agent, such as lecithin, such that it is ready for further use and sheet removal may be facilitated thereafter.

The reconstituted tobacco sheets of the present invention may be cut into squares of about two inches to about six inches square by a cutting device after they have been removed from the stainless steel belt. Any cutting device may be employed, although a chevron cutter is preferred. A size of about four inches square is preferable such that blending with cut whole leaf tobacco may be readily achieved prior to the preparation of tobacco filler.

As illustrated in TABLE 6 below, the reconstituted tobacco sheets produced in accordance with the process of the present invention demonstrate far superior characteristics as compared with the reconstituted tobacco sheet prepared by a conventional process, reported as the control in TABLE 6, with any of the four tobacco particle sizes chosen.

The same slurry was used to prepare both the control and the test sheets for a given particle size reported in TABLE 6, except that a vacuum of about 15-inches of mercury was drawn on the slurry to deaerate it prior to casting the test sheet. Because of difficulties in reproducing slurries in the laboratory, data from a given test sheet should be compared to its control only, and should not be compared to data from other tests.

TABLE 6

EFFECT OF REMOVAL OF AIR ENTRAINED IN SLURRIES OF VARIOUS TOBACCO MESH SIZES ON RECONSTITUTED TOBACCO SHEET (Tobacco Pectin Release By DAP & Ammonia)

| | Control | Test | % |
|---|---|---|---|
| | | 40 Mesh* | |
| Air in Slurry (cc/kg) | 21 | 7 | −67 |
| Ammonia in Slurry (%) | 0.62 | 0.62 | — |
| Sheet Weight (gms/ft$^2$) | 10.7 | 10.9 | — |
| Sheet Thickness (1/1000") | 5.7 | 5.1 | −10 |
| Equilibrium OV (%) | 14.9 | 14.0 | — |
| Tensile Strength (kg/in) | 0.74 | 1.03 | +39 |
| Elongation (%) | 3.6 | 3.6 | 0 |
| TEA (kg/in/in$^2$ × 1000) | 24 | 34 | +42 |
| | | 120 Mesh* | |
| Air in Slurry (cc/kg) | 32 | 17 | −47 |
| Ammonia in Slurry (%) | 0.72 | 0.72 | — |
| Sheet Weight (gms/ft$^2$) | 11.2 | 11.0 | — |
| Sheet Thickness (1/1000") | 4.8 | 4.3 | — |
| Equilibrium OV (%) | 17.4 | 16.1 | — |
| Tensile Strength (kg/in) | 0.59 | 0.86 | +46 |
| Elongation (%) | 1.4 | 1.9 | +36 |
| TEA (kg/in/in$^2$ × 1000) | 8 | 15 | +88 |
| | | 200 Mesh* | |
| Air in Slurry (cc/kg) | 22 | 10 | −54 |
| Ammonia in Slurry (%) | 0.67 | 0.66 | — |
| Sheet Weight (gms/ft$^2$) | 10.2 | 10.6 | — |
| Sheet Thickness (1/1000") | 4.4 | 4.3 | — |
| Equilibrium OV (%) | 15.8 | 16.4 | — |
| Tensile Strength (kg/in) | 0.82 | 1.12 | +37 |
| Elongation (%) | 2.0 | 3.0 | +50 |
| TEA (kg/in/in$^2$ × 1000) | 15 | 32 | +113 |
| | | 400 Mesh** | |
| Air in Slurry (cc/kg) | 30 | 10 | −67 |
| Ammonia in Slurry (%) | 0.69 | 0.68 | — |
| Sheet Weight (gms/ft$^2$) | 9.6 | 10.2 | — |
| Sheet Thickness (1/1000") | 4.3 | 4.1 | — |
| Equilibrium OV (%) | 17.4 | 16.8 | — |
| Tensile Strength (kg/in) | 0.82 | 1.05 | +28 |
| Elongation (%) | 2.2 | 3.5 | +59 |
| TEA (kg/in/in$^2$ × 1000) | 19 | 33 | +74 |

*Slurry aged for 3 hours prior to casting.
**Slurry not aged.

Reconstituted tobacco sheets formed from the process described herein may be used alone or in combination with whole leaf tobacco to create filler suitable for use in cigarettes and other smoking articles. The whole leaf tobacco used in conjunction with these reconstituted tobacco sheets may be from any of the tobacco varieties discussed above. The methods of the present invention are capable of producing reconstituted tobacco sheets that are comprised substantially of only one of the tobacco varieties identified or, alternatively, may be comprised of any combination of them.

Although the present disclosure refers to sheets made from reconstituted tobacco, it is contemplated that the present invention encompasses tubes, foils, rods and the like of reconstituted tobacco in continuous or committed form. Similarly, any of these reconstituted tobacco structures may be used advantageously to prepare tobacco filler when these structures are subjected to the appropriate processes. Moreover, it is also contemplated by the present invention that other smokable compositions based upon other combustible materials well known in the art including a variety of naturally occurring or cultivated leaf-bearing plants may likewise be formed, either individually or in combination with tobacco, into similar structures as described herein by the processes of the present invention.

It is also contemplated by the present invention that the dust particles of other leaf bearing plants may benefit from the process described herein to manufacture reconstituted sheets or other structures comprising dust of these leaves for purposes that are not necessarily associated with the combustion process of smoking articles.

The following examples are provided for the purposes of illustration and are in no way intended to limit the scope of the present invention.

EXAMPLES

Example 1 (Run 37)

A slurry of tobacco particles wherein at least 95% of the particles by weight passed through a 120 mesh screen was prepared in a Waring Blender to obtain a slurry having about 17% total solids content comprising about 10 parts citrus pectin, about 7 parts of propylene glycol, and about 3.7 parts glycerin per 100 parts of 120 mesh tobacco dust in enough water to prepare about a 25% pectin dispersion.

After the slurry was prepared, a vacuum of about 15-inches of mercury was applied to the slurry by means of a vacuum pump for a period of about 2 minutes in order to remove air that had become entrained in the slurry due to, among other things, the high shear mixing of the Waring Blender.

The slurry was then transferred a casting box without ageing, and a sheet was cast onto a clean stainless steel plate. This plate had been pretreated with lecithin to facilitate sheet removal from it. The newly cast sheet was dried on a steam bath for a period of from about 3 minutes to about 4 minutes before it was doctored from the plate.

The testing OV was determined to be about 14.1%. This reconstituted tobacco sheet had a sheet weight of about 12.0 gm/ft$^2$; a sheet thickness of about 8.7 mil; and a sheet density of about 0.58 gm/cc.

By applying a vacuum to the slurry, pitting—which is typically found in sheets of this type—was drastically reduced. The physical quality of the sheet was measured and determined to be: tensile strength, 1.4 kg/in; TEA×10$^3$, 27.0 kg/in/in$^2$; and elongation, 1.9%.

Example 2 (Run 64)

To evaluate and compare the quality of the sheet prepared in Example 1, a tobacco slurry having about 17% total solids content was prepared in a Waring Blender using the same components as described above in Example 1. However, for this sheet, no vacuum was applied to the pre-cast slurry. The testing OV was determined to be about 14.8%. The physical characteristics of this reconstituted tobacco sheet were: sheet weight, 17.0 gm/ft$^2$; sheet thickness, 2.8 mil; and sheet density, 0.56 gm/cc.

The physical quality of this reconstituted tobacco sheet was determined to be: tensile strength, 1.07 kg/in; TEA×10$^3$, 16.4 kg/in/in$^2$; and elongation, 1.8%.

Example 3 (Run 38)

A tobacco slurry was prepared in a Waring Blender comprising about 10 parts of citrus pectin, about 3.7 parts of glycerin and about 7 parts of propylene glycol per 100 parts of 400 mesh tobacco in water. The slurry was determined to have a total solids content of about 18% in enough water to prepare about a 25% pectin dispersion.

This slurry was subjected to a vacuum of about 15-inches of mercury for a period of about 2 minutes in order to remove air that had become entrained within the slurry. The slurry was cast and dried as described above in Example 1. The testing OV was determined to be about 15.3%. The physical characteristics of the finished sheet were: sheet weight, 14.2 gm/ft$^2$; sheet thickness, 5.4 mil; and sheet density, 1.16 gm/cc.

By using tobacco particles of about 400 mesh, a sheet with improved physical quality was produced. The physical quality of the sheet was measured and determined to be: tensile strength, 1.88 kg/in; TEA×10$^3$, 62.7 kg/in/in$^2$; and elongation, 3.6%.

Example 4 (Run 67)

A tobacco slurry was prepared in a Waring Blender comprising the same components in approximately the same proportions as those used in Example 3 above. A total solids content of about 19% was achieved for the slurry. No vacuum was applied to the pre-cast slurry although the slurry was cast and dried as described in Example 1.

The testing OV was determined to be 14.4%. The physical characteristics of the reconstituted tobacco sheet were determined to be: sheet weight, 13.2 gm/ft$^2$; sheet thickness, 5.7 mil; and sheet density, 0.98 gm/cc.

By omitting the vacuum, a marked decrease in the physical quality of the sheet in terms of survivability was observed. The characteristics of the sheet formed without the application of vacuum were: tensile strength, 1.9 kg/in; TEA×10$^3$, 37.3 kg/in/in$^2$; and elongation, 2.1%.

While the invention has been particularly shown and described with reference to preferred embodiments, it will be understood by those skilled in the art that various changes in form and details may be made without departing from the spirit and the scope of the invention.

I claim:

1. A process of manufacturing a reconstituted tobacco sheet suitable as a component of a cigarette cut filler, comprising the steps of:

(a) preparing a slurry comprising mixture of tobacco dust with a mean particle size in the range of from about 120 mesh to about 400 mesh, a binder consisting of a guar gum and an aqueous medium, said slurry having a total solids content from about 15% to about 30%, said step of preparing the slurry being free of any introduction of non-tobacco fiber;

(b) casting the slurry onto a supportive device;

(c) drying the cast slurry to form a reconstituted tobacco sheet; and (d) removing the reconstituted tobacco sheet from the supportive device;

wherein said binder is about 8% or less of the total solids content of said slurry; and wherein the amount of said binder is at a tobacco to binder weight ratio of from about 50:1 to about 10:1.

2. The process as claimed in claim 1, further comprising the step of:

(e) after said removing step, treating the supportive device with an acidic agent.

* * * * *